US008327481B2

(12) United States Patent
Molinaro

(10) Patent No.: US 8,327,481 B2
(45) Date of Patent: Dec. 11, 2012

(54) DEVICE FOR PROVIDING ELEMENTS FOR SURVIVAL

(75) Inventor: Joseph Molinaro, Irvine, CA (US)

(73) Assignee: Relief Pod International LLC, Santa Ana, CA (US)

( * ) Notice: Subject to any disclaimer, the term of this patent is extended or adjusted under 35 U.S.C. 154(b) by 0 days.

(21) Appl. No.: 12/251,436

(22) Filed: Oct. 14, 2008

(65) Prior Publication Data

US 2009/0038075 A1 Feb. 12, 2009

Related U.S. Application Data

(63) Continuation of application No. 11/328,851, filed on Jan. 10, 2006, now abandoned.

(51) Int. Cl.
*A61G 1/04* (2006.01)

(52) U.S. Cl. ..... 5/625; 5/628

(58) Field of Classification Search ..... 296/20; 280/33.998, 79.2; 5/625–628
See application file for complete search history.

(56) References Cited

U.S. PATENT DOCUMENTS

| | | | | | |
|---|---|---|---|---|---|
| 2,880,427 | A | * | 4/1959 | Atwood | 5/627 |
| 3,886,606 | A | * | 6/1975 | Bradford | 5/627 |
| 4,688,279 | A | * | 8/1987 | Vance | 5/626 |
| 5,502,854 | A | * | 4/1996 | Daouk | 5/627 |
| 5,509,159 | A | * | 4/1996 | Du-Bois | 5/627 |
| 5,918,331 | A | * | 7/1999 | Hall et al. | 5/626 |
| 5,987,673 | A | * | 11/1999 | Smith | 5/627 |
| 6,155,260 | A | * | 12/2000 | Lavin et al. | 128/845 |
| 6,363,936 | B1 | * | 4/2002 | McCormick et al. | 128/870 |

OTHER PUBLICATIONS

Joseph Molinaro, "Survival Pod—Presetation [sic] of Concept," Submission to 2003 Industrial Design Excellence Awards contest.

* cited by examiner

*Primary Examiner* — William Kelleher
(74) *Attorney, Agent, or Firm* — Miller Nash LLP

(57) ABSTRACT

A device for providing elements of survival, including two components that attached together form a sealed compartment. One side of the compartment is substantially flat to enable the transportation of persons or materials, and has a number of handles to facilitate transportation.

26 Claims, 14 Drawing Sheets

DEVICE FOR PROVIDING ELEMENTS FOR SURVIVAL

CROSS-REFERENCE TO RELATED APPLICATIONS

The present application claims priority to U.S. patent application Ser. No. 11/328,851 filed on Jan. 10, 2006, the contents of which is incorporated herein in its entirety.

BACKGROUND OF INVENTION

Every few years massive flooding destroys the South African country of Mozambique, leaving hundreds of thousands of people homeless, without water, food and shelter. In February 2000, torrential rains and massive flooding killed more than 600 people, while fourteen thousand were rescued by helicopter and thousands more were taken to safety by boat. Hundreds of thousands of people crowded into only dozens of emergency camps scattered across the southern part of the country.

The overwhelming number of victims needing immediate emergency aid inundated relief workers and exhausted local supplies. Attempting to administer first aid to masses of refugees was inefficient, at the cost of human lives. Under camp conditions, hepatitis, cholera, and other water-borne bacteria and diseases spread rapidly.

Water purifying stations were brought in for relief, but again, it was not enough to accommodate the sheer volume of refugees, forcing them to make long journeys to reach a purifying station or survive without clean water.

Agencies supplying shelter in the form of canvas tents were also unable to meet demands, leaving the majority of victims to huddle under plastic tarps. Still others had no shelter at all, left to the mercy of endless torrential downpours. Under these extreme and inhumane conditions, children were the first to suffer from disease, poor nutrition, and exposure.

Before the February 2000 floods, Mozambique, with an annual growth rate of 10 percent, had one of the most rapidly developing economies in Africa. The country is now on the brink of disaster. A report issued by the United Nations Environment Programme anticipates that Africa will face worsening weather conditions due to global warming, warning of more flooding in Mozambique coupled with drought and famine in other areas.

Water can be a dangerous element in disaster situations. From Mozambique to St. Louis, excessive rainfall and flash flooding can destroy an entire city and kill thousands of people. Dangerous currents carry away families, homes, towns, leaving nothing but destruction in their wake. Bodies of water even act as barriers to survivors trying to escape to safety.

There exists a need to provide a substantially-universal, relatively low-technology, and compact solution that incorporates the essential elements needed for human survival.

SUMMARY OF THE INVENTION

According to one embodiment of the present invention, a device for providing elements of survival comprises two substantially similar components that are connectable to one another. When the two components are connected to each other they form a sealed compartment. The two components further comprise a substantially flat surface and at least one handle coupled to each of the two components.

The device of the present invention can be used to assist in the storage, delivery, preparation and presentation of a number of support items. The support items include, for example, first aid and medication, water purification, food, shelter, and a means for transporting supplies and people. These features are provided in a device that is airtight, watertight, compact, and well suited for transportation and distribution. It is a further object of an embodiment of the present invention to provide a device that is distributable and self-contained, enabling users of the device to provide assistance to themselves and others.

Although specific advantages have been enumerated above, various embodiments may include all, some, or none of the enumerated advantages. Additionally, other technical advantages may become more readily apparent to one of ordinary skill in the art after review of the following figures and descriptions.

DETAILED DESCRIPTION

Figure 1:
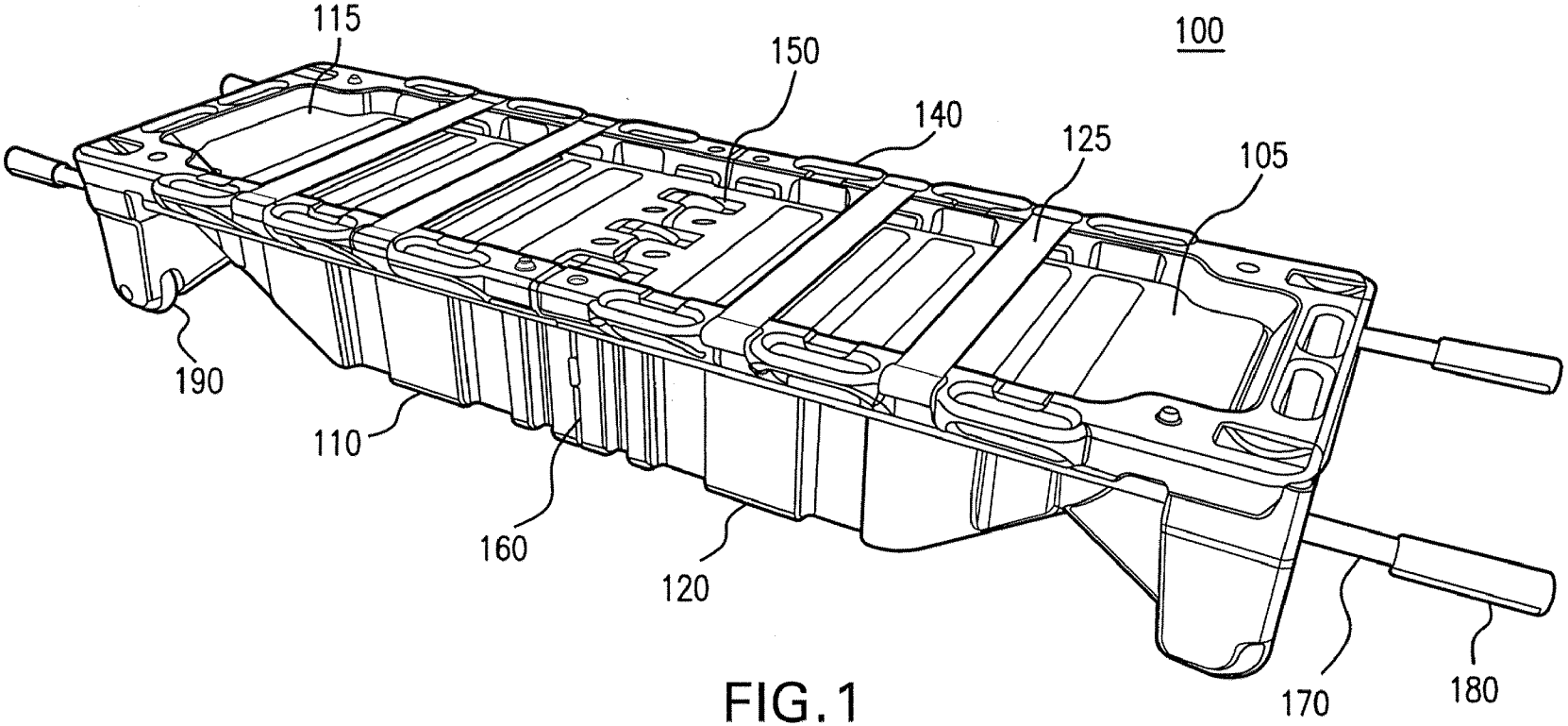
FIG. 1 is a three-dimensional elevated view of an embodiment of the device of the present invention.

FIG. 1 is a three-dimensional elevated view of the present device. A device 100 is comprised of two substantially similar sub-components designated as 110 and 120. Because sub-components 110 and 120 are substantially-similar, the same or similar mold can be used to manufacture each sub-component 110 and 120 of device 100.

The device 100 can be made of durable and reusable materials, such that it has structural strength and integrity and can be used in a number of diverse geographical ranges, varying weather conditions, and numerous environmental conditions. This may include, for example, varying temperature ranges, wind conditions, and precipitation levels due to rain, snow, hail, sleet, or any combination thereof. In one embodiment, the sub-components 110 and 120 are fabricated using rotationally molded polypropylene. In another embodiment, the device 100 can be fabricated using less-durable or disposable materials such that the device is easy to fabricate, inexpensive, and discardable if needed.

Returning to FIG. 1, device 100 comprises sub-components 110 and 120, which are secured together with a locking system. The locking system secures sub-components 110 and 120 by utilizing a number of locking mechanisms 150, such as catches or re-attachable fasteners, and a gasket 160. In one embodiment, the gasket is rubber so that ideally the seal between sub-components 110 and 120 is substantially airtight and watertight, thus creating a substantially airtight compartment within device 100. The gasket 160 can be made from a number of materials that can provide a substantially water tight and air tight seal between sub-components 110 and 120.

Figure 3:
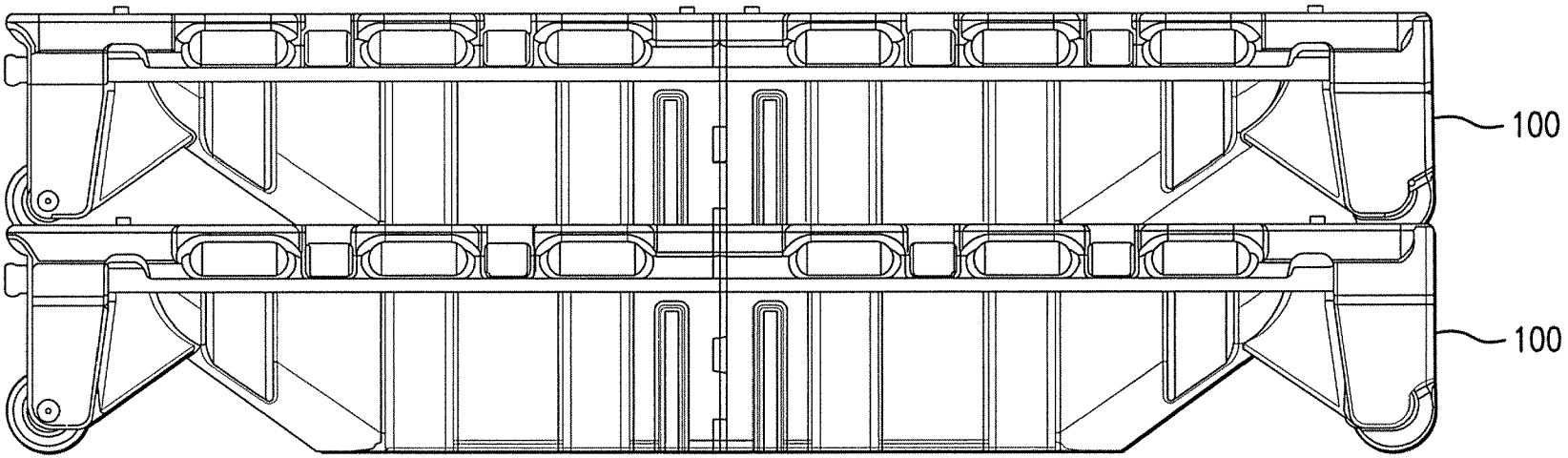
FIG. 3 is an elevated view of an embodiment of the device of the present invention showing one device stacked on another device.

Referring to FIG. 3, a number of devices 100 can be stacked on top of one another in a vertical direction such that each is positioned on a horizontal plane. This allows a number of devices 100 to be stacked such that they can occupy a relatively small amount of space during storage or transportation.

Returning to FIG. 1, a mat cover 105 and a raised pillow-like area 115 can be positioned on the surface of sub-components 110 and 120. The mat cover 105 can be a substantially non-slip material such as rubber, cloth, foam, or any other similar material that can provide a substantially non-slip surface. A mat cover 105 made of foam, for example, can be used to cushion the body and head. The raised pillow-like area 115 can protect the neck and spinal cord. In one embodiment the mat cover 105 and pillow-like area 115 are fabricated from non-absorbent material and capable of outdoor use.

A number of adjustable straps 125 may be provided to allow for stabilization of persons positioned on the device 100, either during transportation or while stationary. A number of straps 125 can be used to secure a person to the device 100. In one embodiment, the straps 125 can be provided by Morrison Medical Strapping System, available at http://www.morrisonmed.com/straps.htm. In one embodiment, the mat may be provided by Junkin SAF-302 COMFO-PAD, at http://www.westernsafety.com/junkin3.html.

The device 100 further comprises handles 140 positioned around the perimeter of sub-components 110 and 120. In one embodiment, the handles 140 are molded elements of sub-components 110 and 120. In an exemplary embodiment, additional handles 170 may be positioned on sub-components 110 or 120. It is understood that a number of handles 170 may be positioned on sub-components 110 and 120. A number of handles 170 can be positioned substantially near the four corners of the device 100.

A number of different materials may be used for the handles 170, as well as a number of different methods and devices for attaching or connecting handles 170 to sub-components 110 and 120. Handle grips 180 may also be positioned on the handles 170. In one embodiment, handles 170 are manufactured from extruded aluminum and are attached to sub-components 110 or 120. The handles 170 are adjustable to allow for the removal or repositioning of handles 170.

A number of wheels 190 can be mounted on sub-components 110 and 120. In one embodiment, two to four wheels are mounted to the device near the four corners of the device. In an exemplary embodiment, the wheels are approximately 5" diameter, have oil-less bearings, are flat free wheels, and are axle secured. The wheels can be provided by Colson Casters 2 Series Performa Rubber Caster Wheel (Round Tread), information available at http://colsoncaster.com/performa2-round-wheel.html.

Figure 2:
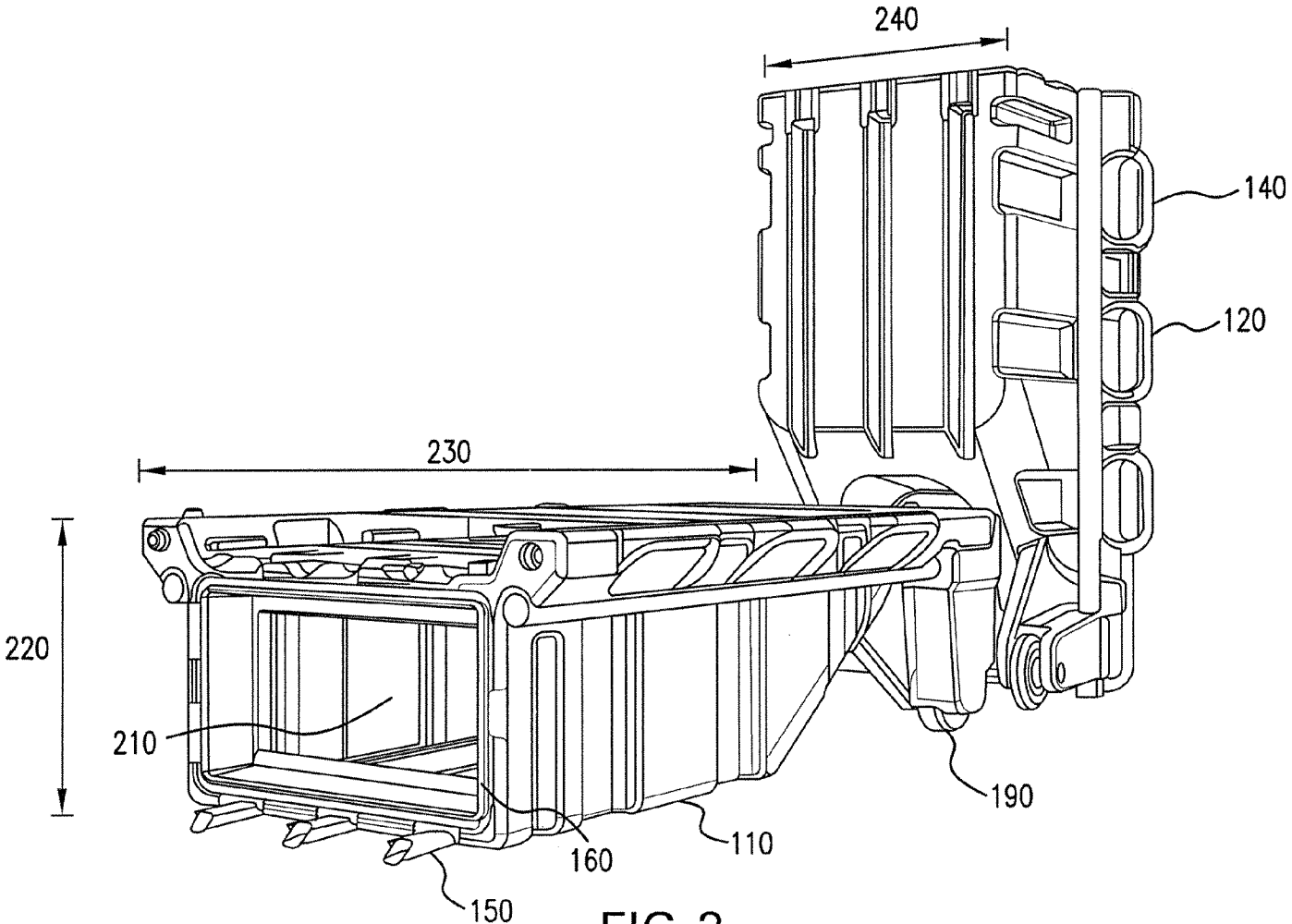
FIG. 2 is a three-dimensional view of an embodiment of the device of the present invention showing two attachable components.

Referring to FIG. 2, sub-components 110 and 120 can be disconnected from one another and used as separate devices. Sub-components 110 and 120 each have an inside compartment 210, which can be used for storing dry or liquid materials. The sub-components can also be positioned in a horizontal position, as shown with sub-component 110, or positioned in an upright position, as shown with sub-component 120.

FIG. 2 shows the approximate dimensions and shape of sub-components 110 and 120. Sub-components 110 and 120 are substantially rectangular in shape wherein the subcomponent height 220 is approximately 14 inches, the length 230 is approximately 44 inches, and the width 240 is approximately 26 inches.

Figure 4:
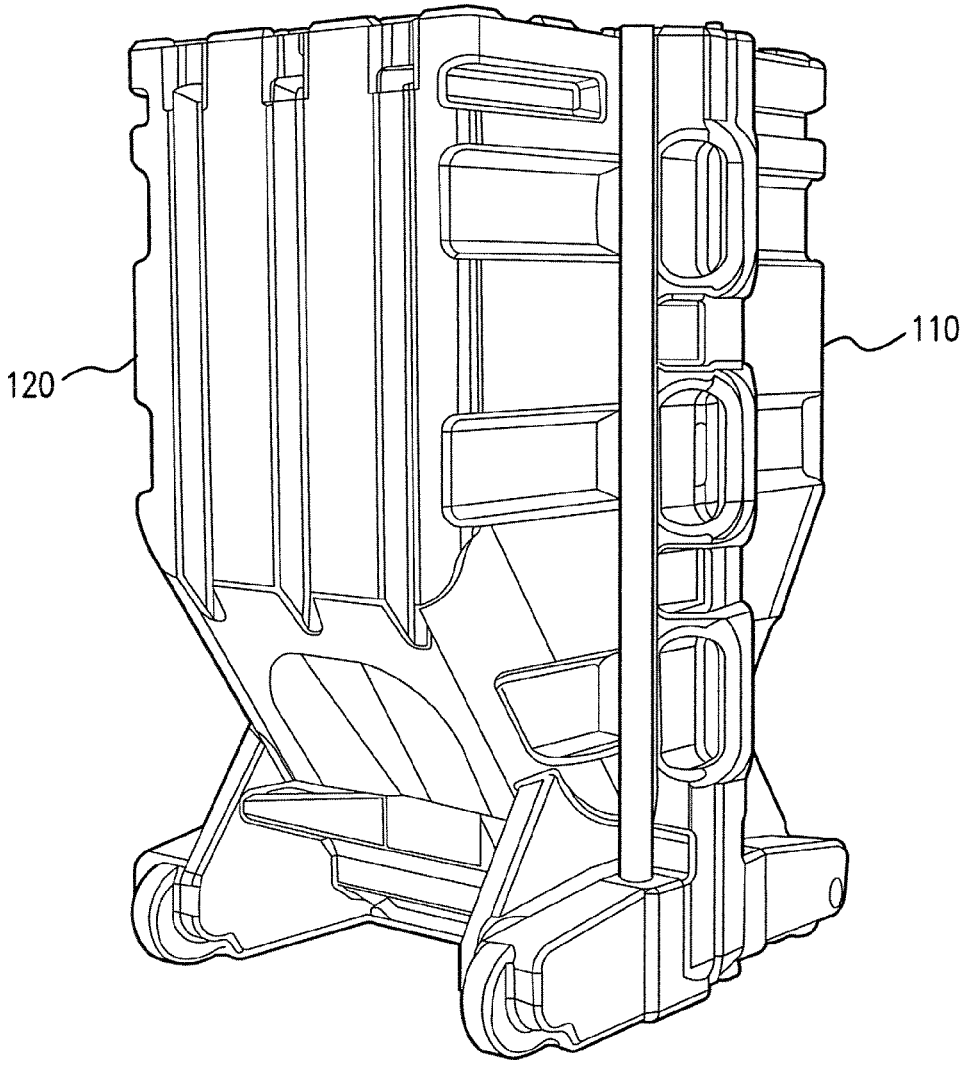
FIG. 4 is a three-dimensional elevated view showing an embodiment of the device of the present invention in an upright attached position.

As shown in FIG. 4, sub-components 110 and 120 can be positioned in an upright attached position. In an exemplary embodiment, sub-components 110 and 120 can be held together in the upright attached position by a fastening mechanism. The straps 125, for example, may be used as the fastening mechanism. The fastening mechanism may be positioned around the exterior of sub-components 110 and 120, or positioned around adjacent handles 140.

The device 100 may include a water purification system, including a water filter, intake hose, securing device, pump, and fastening mechanism. The water purification system can be pre-fabricated and attached or connected to sub-components 110 or 120 by a securing device. In one embodiment, the securing device is made from a rust-resistant material such as brass.

In an exemplary embodiment, the water purifying system filter may be provided by General Ecology First Need Deluxe Portable Water Purifier, information available at http://www.generalecology.com/firstneeddelux.htm#FirstNeed, or by MSR WaterWorks EX Microfilter, at http://www.msrgear.com/filters/waterworks_ex.asp.

The water purification system can be positioned on sub-component 110 or 120 such that the pump and filter are protected from outside elements thus reducing the possibility of contamination. Water purifying chemicals may also be added to purify the water, which can be included in the device 100 along with instructions for use. The type and amount of chemicals used can be determined by the environment and severity of the contamination, as well as the intended use of the water (e.g., human consumption, animal consumption, irrigation, washing or cleansing).

The device 100 provides many different methods of collecting, purifying, and storing water, allowing the device 100 to adapt to different circumstances. While in the adjacent upright attached position, either or both sub-components 110 and 120 can be used as a container to hold unpurified or purified water.

Each sub-component 110 and 120 can be designed to hold several gallons of purified or unpurified water. Using the pump, which can be, for example, a hand pump, battery powered pump, or electric powered pump, water is transferred from one sub-component to the other sub-component and through the water purification system.

Returning to FIG. 4, when either or both sub-components 110 or 120 are positioned in the upright attached position, either or both sub-components may be used as a collection unit for collecting water. In the event there is a source of water nearby, the intake hose may be used in conjunction with the pump to transfer water from the source to the water purifying system, or to sub-components 110 or 120. In an exemplary embodiment, sub-components 110 or 120 or an alternative vessel may be taken to the water source and used to transport water. The fastening mechanism, or straps 125, may also be used to transport either sub-component if necessary. The alternative vessel for transporting water can be provided with the device 100, such as, for example, a messenger bag.

A lid can be provided to cover the water stored in either sub-component 110 or 120, and may be used to protect the water from the entry of impurities or foreign objects. This storage system helps prevent the water from further contamination due to dust, insects, or polluted rain. A water transport bag, or messenger bag, could also be used to as the lid cover the open compartments 110 and 120. In an exemplary embodiment, the transport bag may be provided by Platypus, Water Tank 4, information available at http://www.altrec-.com/shop/detail/15326/PLA/photo.

Figure 5:
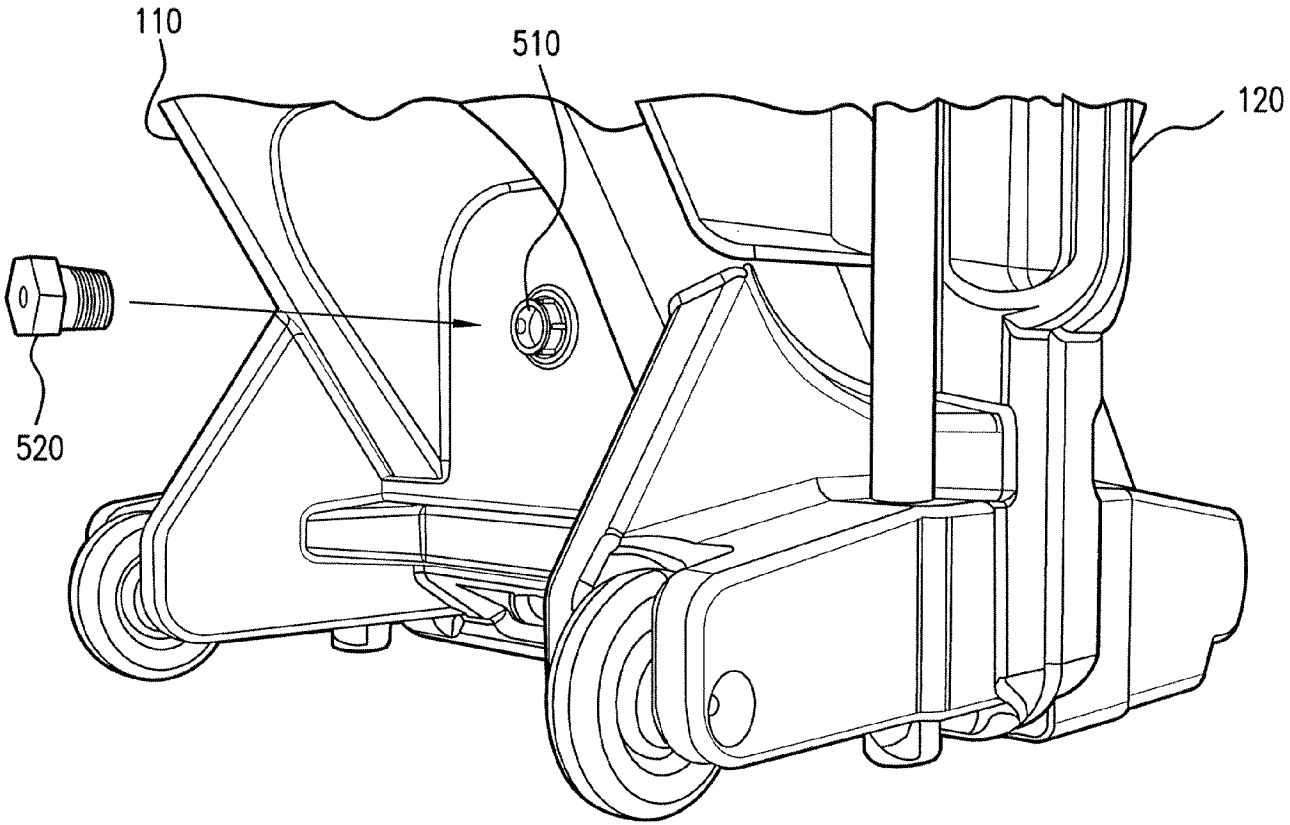
FIG. 5 is a three-dimensional sectional view of an embodiment of the device of the present invention showing a spigot and cap.
Figure 6:
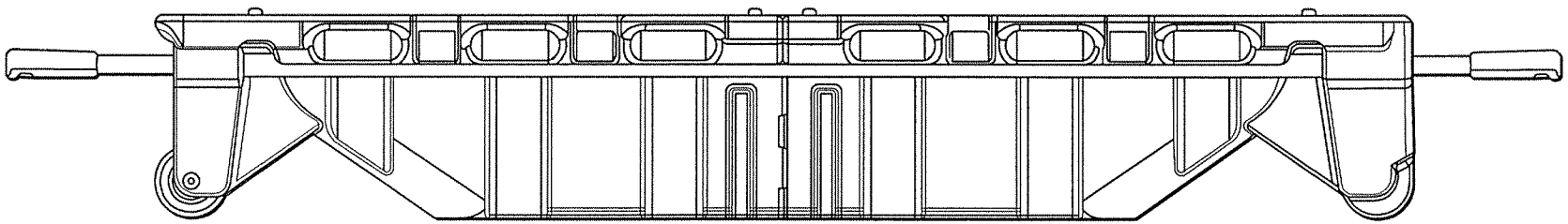
FIG. 6 is a side elevation view of an embodiment of the present device of the present invention.
Figure 7:
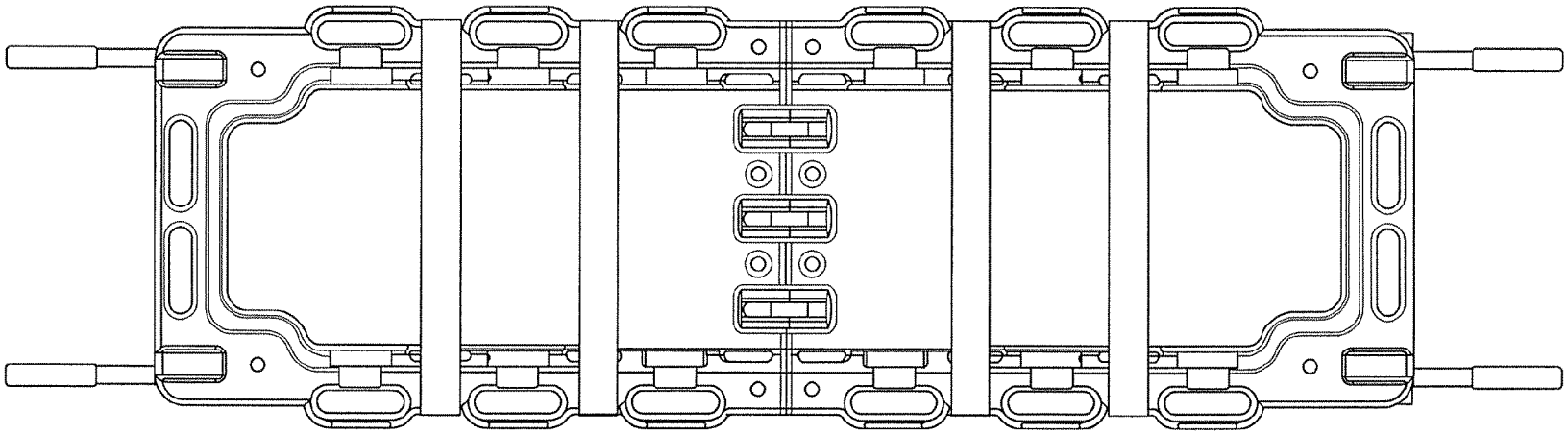
FIG. 7 is a top plan view of an embodiment of the present device of the present invention.
Figure 8:
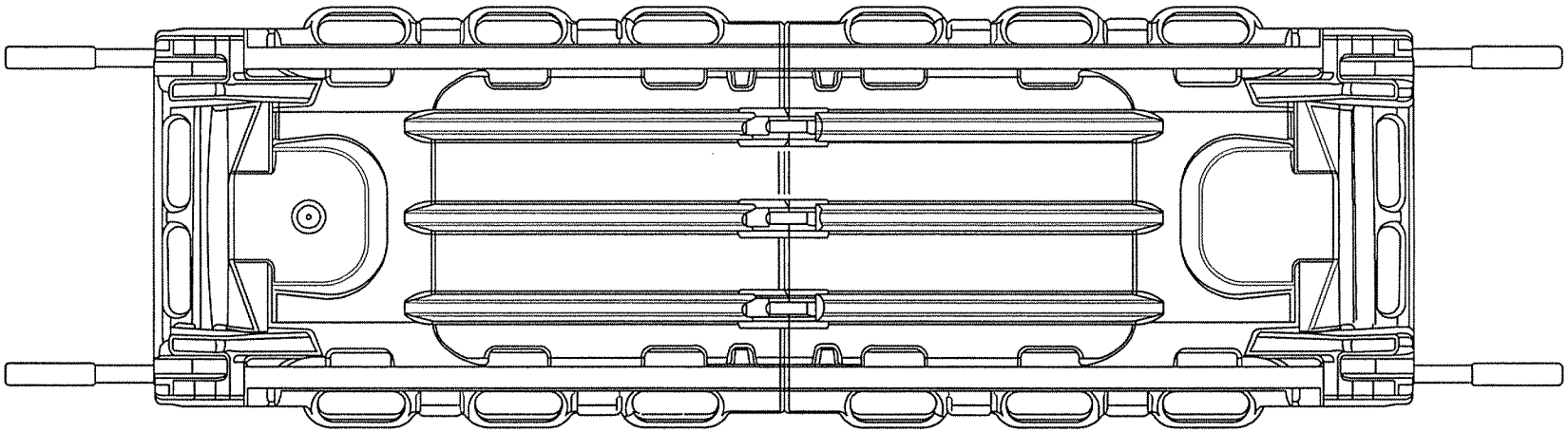
FIG. 8 is a bottom plan view of an embodiment of the present device of the present invention.
Figure 9:
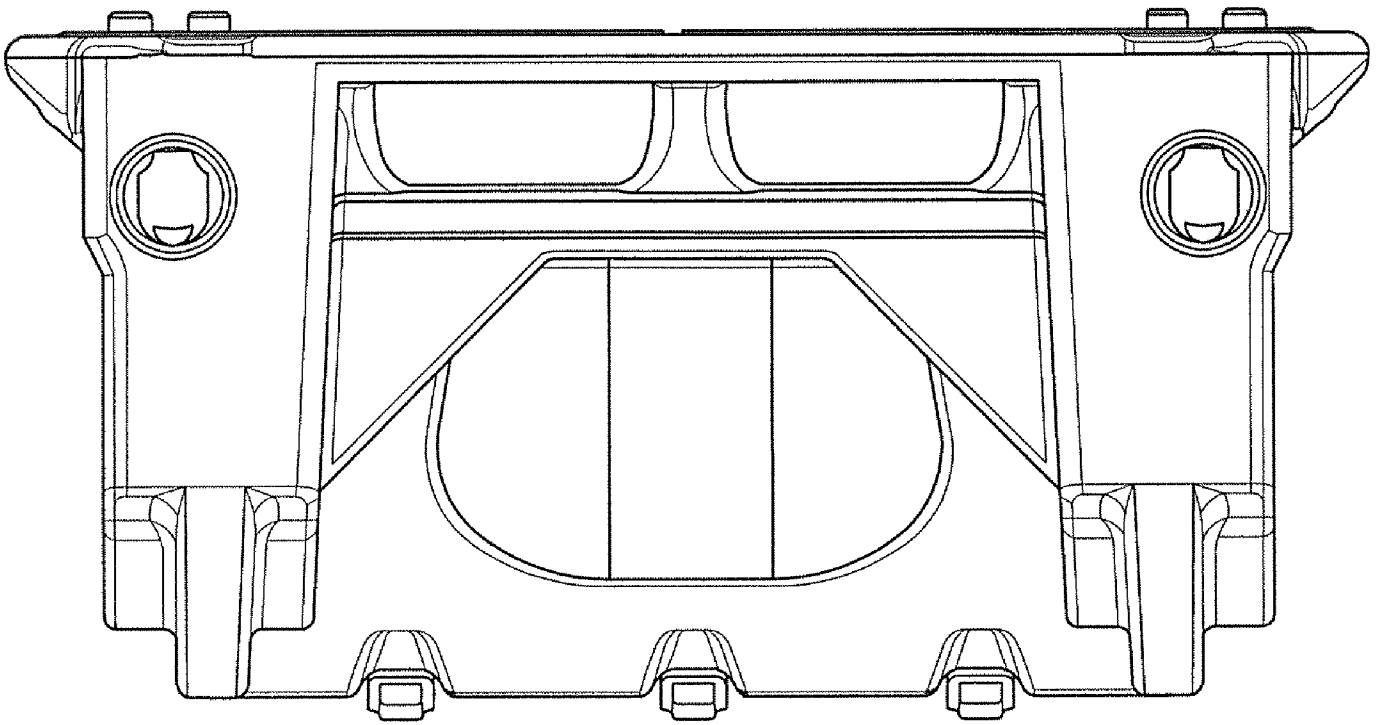
FIG. 9 is a side elevation view of an embodiment of the present device of the present invention.
Figure 10:
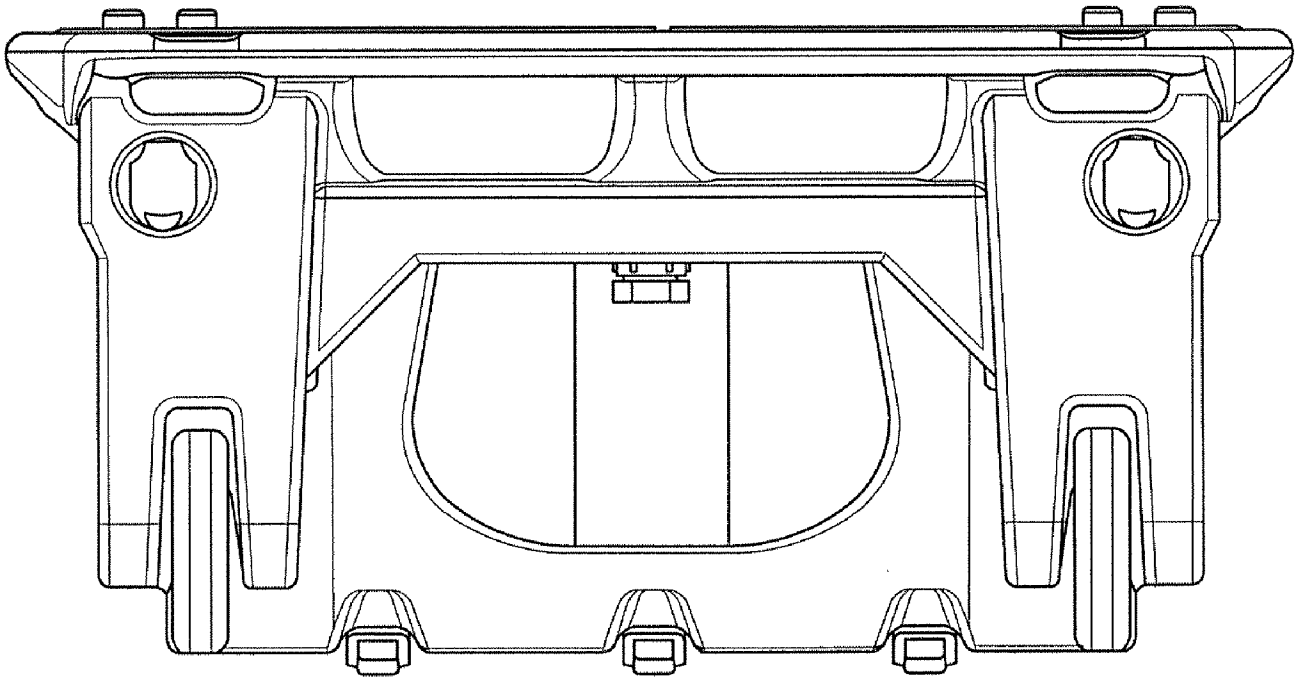
FIG. 10 is a side elevation view of an embodiment of the present device of the present invention.
Figure 11:
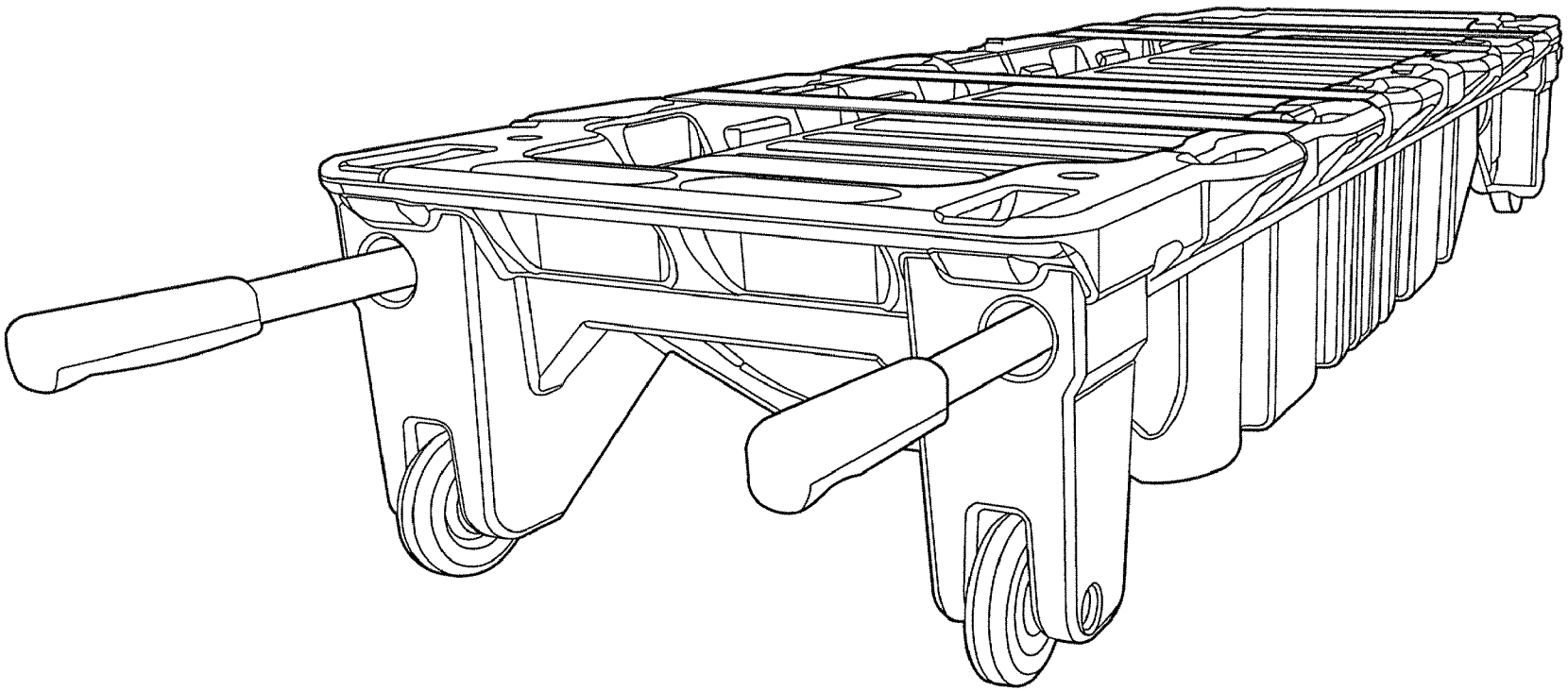
FIG. 11 is a three-dimensional elevated view of an embodiment of the device of the present invention.
Figure 12:
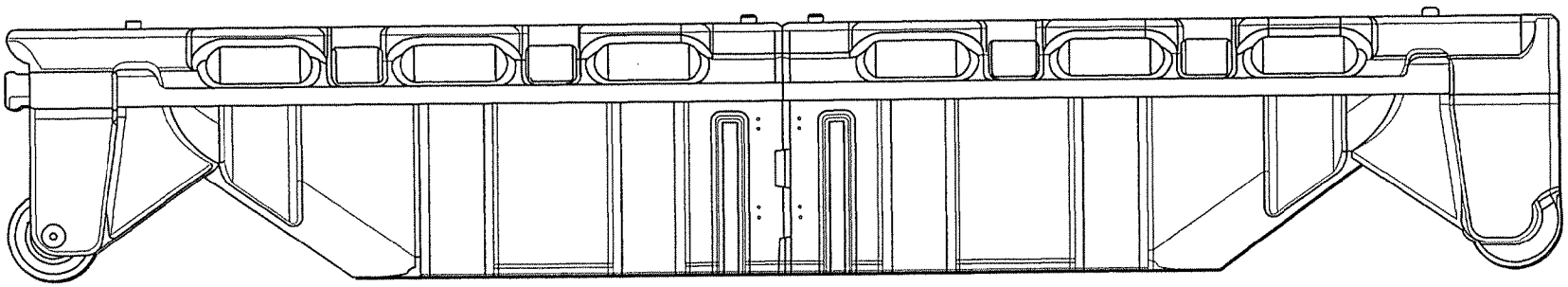
FIG. 12 is a side elevation view of an embodiment of the present device of the present invention.
Figure 13:
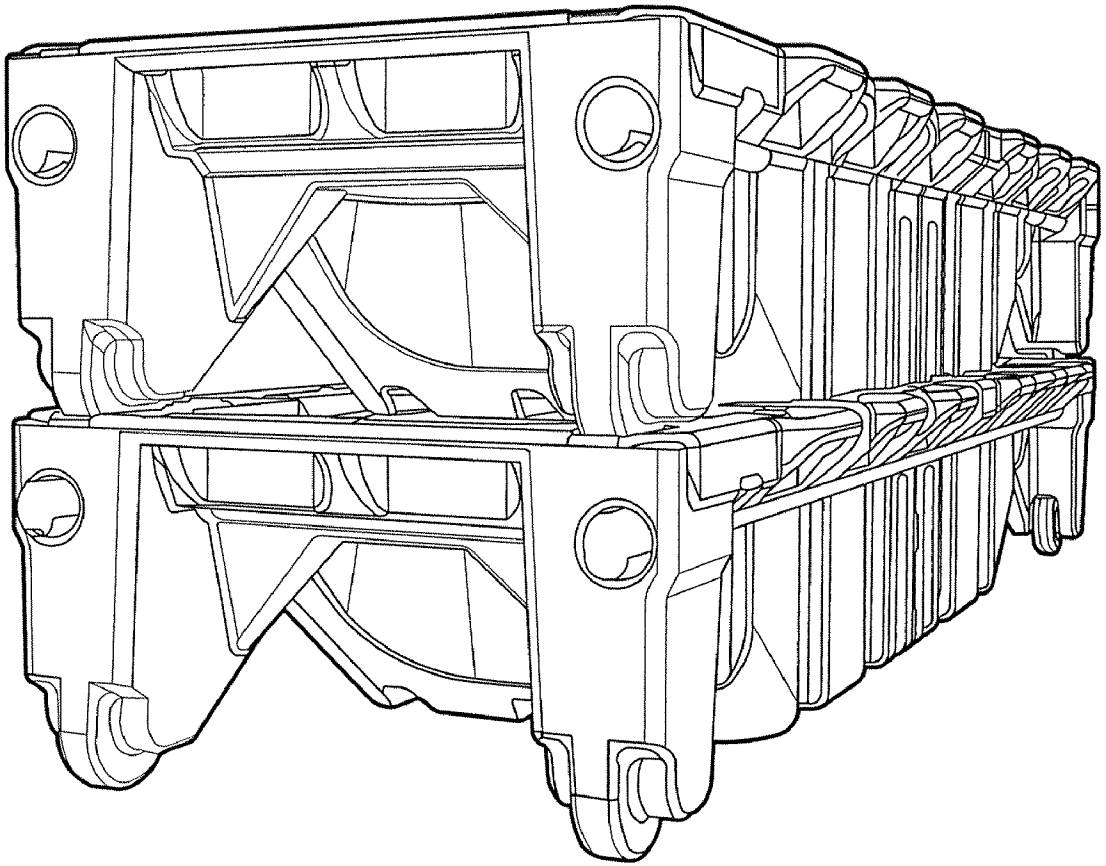
FIG. 13 is a three-dimensional elevated view of an embodiment of the device of the present invention showing one device stacked on another device.
Figure 14:
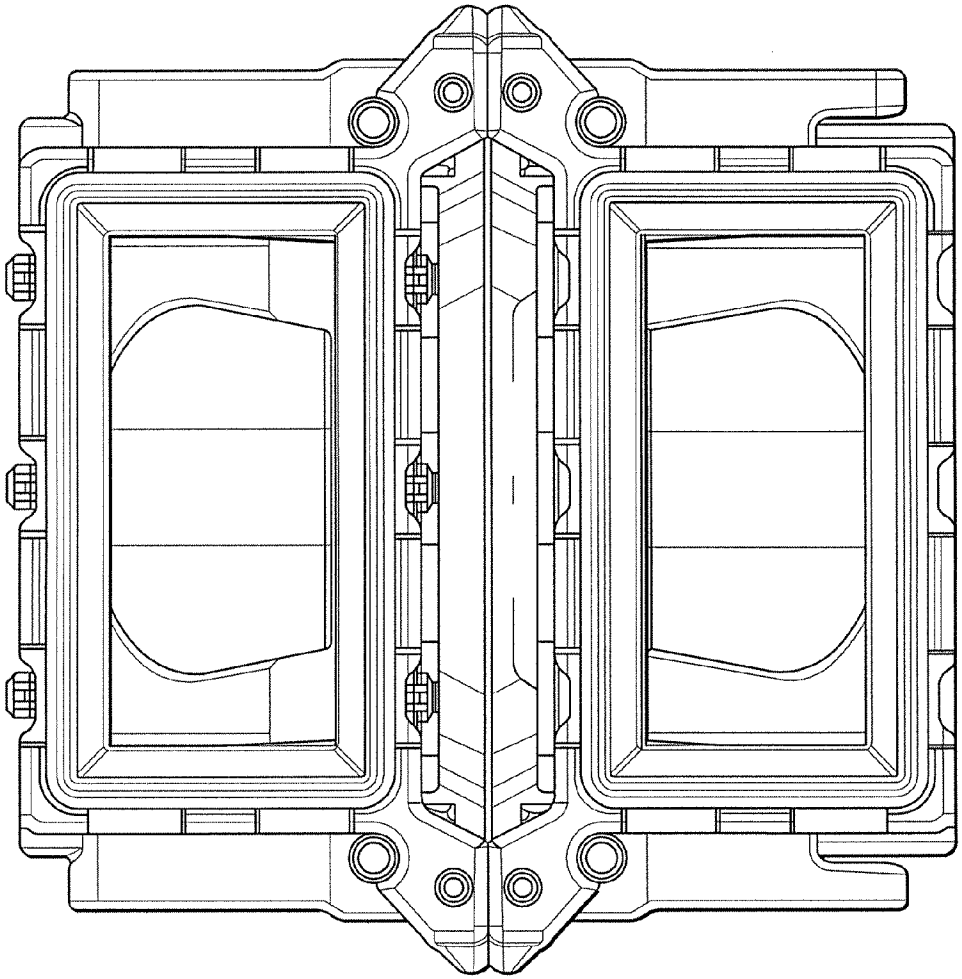
FIG. 14 is a plan view of an embodiment of the top of the device of the present invention in the upright attached position.

As shown in FIG. 5, a spigot 510 can be positioned on sub-component 110 or 120 and is used to dispense liquid contained in either sub-component 110 or 120. The spigot 510 is capped with fitting 520. In one embodiment the spigot is relatively short such that it does not easily break; and should be drip free. In an exemplary embodiment, a spigot may be provided by Rubbermaid Replacement Spigot 27947, information available at http://www.mainstsupply.com/product.cfm/7/53/27947 or by Spigot Kit for Rubbermaid "Brute" Greenskeeper, information available at http://www.instawares.com/Spigot-Kit-For-Rubbermaid-Brute-Greenskeeper.2621096.0.7.htm.

It may be useful to set forth a number of exemplary embodiments and uses of device 100. The device may be presented in a number of embodiments and uses by altering the supplies and/or materials provided within the device upon deployment.

EXAMPLES

Medical

The present device allows persons to administer aid, purify water, create shelter, and transport others to safety. The device 100 can be a water proof storage space with the capacity to hold a large quantity of water and first aid supplies including, but not limited to, drugs, vaccinations, bandages, and tools necessary to treat others. Persons located in one geographical area may receive different materials or supplies included within the device 100, which may be adjusted to accommodate the needs that are specific to the geographic, economic, or social conditions.

When the device 100 is in the open and horizontal position, the device becomes a means for transportation of persons, similar to a stretcher. A padded surface may be included on the device 100 to protect the neck and spinal cord or provide comfort for the person being transported. Two adjustable straps may be included for stabilization of persons during transportation.

Shelter

The device 100 may be used to provide portable shelter. Disassembled shelter can be stored inside of the device 100, thus making the shelter easy for transport. When a user of device 100 reaches a safe and desirable destination, the user can assemble the shelter.

A shelter, such as a tent, for example, may be a prefabricated product that is inserted into the device 100 and capable of housing a varying number of people. The device 100 can also be used as the tent's frame. The roof of the tent can be used to collect water and channel water to the device's water purification system.

Various types and sizes of shelter can be provided based on the conditions and intended use. For example, shelters providing protection against a number of environmental conditions including precipitation, wind, sun, or even a sandstorm may be provided within the device 100. Different size shelters could also be provided according to average family size of the region. Several shelters could be connected together to create a spiritual center or gathering area according to cultural preference and custom of the particular region in which the device 100 is used. In an exemplary embodiment, the shelter may be provided by Shelter Systems Emergency Disaster Relief Tent Shelters, information available at http://www.shelter-systems.com/relieftents/relieftents.html.

Flotation

The device 100 can become a rescue device for flood victims by transforming into a floating vessel. In its connected position, it locks together and becomes airtight and buoyant, protecting contents inside the device. In an exemplary embodiment, the handles 170 can be detached from the device 100 and arranged to create an oar to be used as a paddle. An example of an oar is available from Carlisle, Economy Oar (6 ft), information available at http://marmot-.altrec.com/shop/detail/6352/CRL.

The device 100 can act as a life raft to rescue victims located in water, trees, or on rooftops. It can be used as a means for transporting persons, such as children, the elderly, the injured, or any person not able to swim. A number of devices 100 may be linked together in a large raft formation to form a safe passage through fast flowing rivers or deep bodies of water. They may also be connected in a linear formation, creating a link across a river, by securing the bridge at each bank. In addition, because it can be provided with an airtight seal, the device 100 is a viable means of transporting essential supplies such as first aid, food, and purified water. It can bring emergency resources to previously inaccessible areas to victims in need.

Transportation

The device 100 can be manufactured such that it is sturdy, lightweight, and transportable. Multiple devices can be stacked on top of each other for group travel during distribution. During movement of a single device, the handles provide a sturdy grip for users to lift and carry the device when it is in its closed and locked position. Each handle can also be attached near a wheel, allowing flexibility in transport and more options to accommodate different types of terrain. The wheels allow one or several persons to move the device by pulling it behind them or pushing it in front of them. This movement allows for the hauling of supplies on top or inside of the device. Supplies, including those that are heavy, awkward, or valuable, can be secured by using the straps. The device can also be used for transporting personal materials salvaged during or after a crisis.

For the transportation of people, the device can be used in its open and horizontal position, because it creates a reasonably stable, flat surface on which to position a person. This surface can be covered with a mat, such as foam padding, which can attach to and detach from the device. The device can be transported, such as by being wheeled, pushed, pulled, carried or floated from location to location. The device 100 can also be equipped with a point of connectivity, such that it can be airlifted by rescue helicopter.

Mission Specific

The device's "mission specific" capabilities through customization allows for the adaptation to many types of situations and circumstances. The device can be altered to meet the specific requirements of a situation by replacing the adaptable elements, such as, for example, first aid and medical supplies, purification systems, and shelter types and sizes. The device, for example, can be designed to provide materials to relieve a cholera epidemic, and can be customized for civilian or military purposes.

Blankets and shelter can be provided to keep victims warm and prevent hypothermia in cold environments. In a state of emergency where conditions are chaotic and unpredictable, supplies could accommodate aid for a variety of threats.

Depending on the characteristics of the particular material used and/or features included, the device can be used as a defensive barrier in conflict. Further uses include a casket, storage for corpses, temporary storage for toxic or hazardous materials to prevent contamination, collection and storage human waste, removal of water from a flooded area, or sustain an enclosed area from flooding that is being filled with water. It can be used to remove water on board a vessel at sea.

Distribution

The device's 100 design provides many options for distribution. Each device can stack substantially compact together thus decreasing the amount of space needed. The devices are designed to stack on standardized pallets for mass air drops. Many devices in a shipment can be delivered in an efficient manner. Devices can be transported by flatbed trucks, cars, buses, troop carriers, or any similar vehicle. The devices can also be dragged by vehicles individually or in stacks or on crates.

Air delivery is also a viable option. The construction of the device allows for large scale crate distribution by cargo plane or small scale supply using helicopter. Air distribution allows access to remote or treacherous locations. The device has a point of connectivity to be airlifted by rescue helicopter.

The device 100 could also be distributed by way of water. For persons located in or near a river or flowing body of water, the devices could be dropped in from boats further away or upstream and float to the area of crisis.

Providing various distribution options reduces the cost and difficulty involved in the delivery of relief supplies, allowing the device to be distributed in many conditions including hazardous conditions, destroyed roads, flooded or muddy roads, strong winds, and lightning.

Although the present invention has been described in connection with specific exemplary embodiments, it should be understood that various changes, substitutions and alterations can be made to the disclosed embodiments without departing from the spirit and scope of the invention as set forth in the appended claims.

I claim:

1. A device for providing elements of survival, comprising:

a first sub-component connectable to a second sub-component, wherein said first sub-component is substantially similar to said second sub-component, and further defined by a sealed compartment when said first sub-component is connected to said second sub-component;

respective first surfaces of said first and second sub-components, wherein said surfaces are substantially flat;

respective second surfaces of said first and second sub-components located opposite to said respective first surfaces;

a plurality of handles coupled to the exterior of said first sub-component, and a plurality of handles coupled to the exterior of said second sub-component;

a sliding handle;

an integral chamber within at least one of said first sub-component or said second sub-component which corresponds to the sliding handle; and a wheel mounted onto an end of at least one of said first sub-component or said second sub-component, wherein said wheel is located substantially between said respective first surfaces and said respective second surfaces and the device provides stationary contact with a transport surface when the device is immobile.

2. The device of claim 1, wherein said first sub-component is connected to said second sub-component by a plurality of locking mechanisms.

3. The device of claim 1, further comprising a gasket positioned between said first sub-component and said second sub-component to provide a sealed compartment.

4. The device of claim 1, wherein said sealed compartment is substantially watertight and substantially airtight.

5. The device of claim 1, wherein said sealed compartment has positive buoyancy.

6. The device of claim 1, further comprising a mat covering positioned on said first surfaces of said first and second sub-components.

7. The device of claim 6, further comprising a raised pillow-like area positioned on said mat covering.

8. The device of claim 1, further comprising at least one fastening mechanism connected to said device.

9. The device of claim 1, wherein said first and second sub-components are substantially rectangular.

10. The device of claim 9, wherein said substantially rectangular sub-components measure approximately 44 inches in length, approximately 26 inches in width, and approximately 14 inches in height.

11. A device for providing elements of survival, comprising:

a first sub-component and a second sub-component, wherein said first sub-component is substantially similar to said second sub-component, and further defined by at least two compartments when said first and second sub-components are positioned in an adjacent and upright position;

respective first surfaces of said first and second sub-components, wherein said surfaces are substantially flat;

respective second surfaces of said first and second sub-components located opposite to said respective first surfaces;

respective side surfaces of said first and second sub-components located between said respective first surfaces and said respective second surfaces;

a plurality of handles coupled to the exterior of said first sub-component, and a plurality of handles coupled to the exterior of said second sub-component;

a sliding handle;

an integral chamber within at least one of said first sub-component or said second sub-component which corresponds to the sliding handle; and a wheel mounted onto an end of at least one of said first sub-component or said second sub-component, wherein said wheel together with at least one of the said side surfaces of said first sub-component or said second sub-component provides stationary contact with a transport surface when the device is immobile.

12. The device of claim 11, further comprising a fastening mechanism for securing said first sub-component to said second sub-component.

13. The device of claim 11, wherein said first and said second sub-components are substantially watertight compartments capable of holding liquid and dry materials.

14. The device of claim 1 wherein said plurality of handles coupled to the exterior of said first sub-component is a plurality of integral handles arranged around the perimeter of said first sub-component, and said plurality of handles coupled to the exterior of said second sub-component is a plurality of integral handles arranged around the perimeter of said second sub-component.

15. The device of claim 11 wherein said plurality of handles coupled to the exterior of said first sub-component is a plurality of integral handles arranged around the perimeter of said first sub-component, and said plurality of handles coupled to the exterior of said second sub-component is a plurality of integral handles arranged around the perimeter of said second sub-component.

16. The device of claim 1 wherein said sliding handle is a detachable handle.

17. The device of claim 11 wherein said sliding handle is a detachable handle.

18. The device of claim 2 wherein said locking mechanisms include at least one of catches or re-attachable fasteners.

19. The device of claim 8 or 12 wherein at least one said fastening mechanism is removable and re-attachable.

20. The device of claim 8 or 12 wherein at least one said fastening mechanism is positioned around adjacent handles.

21. The device of claim 12 wherein at least one said fastening mechanism is positioned around the exterior of said first sub-component and said second sub-component.

22. The device of claim 16 or 17 wherein the sliding handle is a paddle.

23. The device of claim 1 wherein the sliding handle is housed substantially within the corresponding integral chamber.

24. The device of claim 11 wherein the sliding handle is housed substantially within the corresponding integral chamber.

25. The device of claim 1 wherein the sliding handle extends outward from the corresponding integral chamber.

26. The device of claim 11 wherein the sliding handle extends outward from the corresponding integral chamber.

* * * * *